US006216481B1

(12) United States Patent
Kantchev

(10) Patent No.: US 6,216,481 B1
(45) Date of Patent: Apr. 17, 2001

(54) REFRIGERATION SYSTEM WITH HEAT RECLAIM AND WITH FLOATING CONDENSING PRESSURE

(76) Inventor: Jordan Kantchev, 1925 Guerin, Longueuil (CA), J4N 1J3

( * ) Notice: Subject to any disclaimer, the term of this patent is extended or adjusted under 35 U.S.C. 154(b) by 0 days.

(21) Appl. No.: 09/396,784

(22) Filed: Sep. 15, 1999

(51) Int. Cl.[7] ..... F25B 27/00
(52) U.S. Cl. ..... 62/238.7; 62/175; 62/238.6
(58) Field of Search ..... 62/79, 175, 238.6, 62/238.7, 332, 333, 117, 196.4, 217

(56) References Cited

U.S. PATENT DOCUMENTS 4,193,781 3/1980 Vogel et al. .
4,502,292 3/1985 Ares et al. .
4,535,603 * 8/1985 Willitts et al. ..... 62/238.6 X
4,711,094 * 12/1987 Ares et al. ..... 62/238.6 X
4,803,848 * 2/1989 LaBrecque .
5,673,567 10/1997 Dubé .
5,689,966 * 11/1997 Zess et al. ..... 62/238.6
5,826,433 10/1998 Dubé .

* cited by examiner

*Primary Examiner*—William Doerrler
*Assistant Examiner*—Chen-Wen Jiang

(57) ABSTRACT

A heat pump system installed on the discharge line of a refrigeration system with floating head pressure (condensing temperature as low as 60° F.) to extract the total rejected heat by the refrigeration system and to elevate the temperature level of the total rejected heat to a value usable in heat reclaim coils with the purpose to provide comfort heating of the building during the cold periods of the year.

When no heat reclaim is required, the heat pump system is used for air conditioning and subcooling purposes.

13 Claims, 3 Drawing Sheets

REFRIGERATION SYSTEM WITH HEAT RECLAIM AND WITH FLOATING CONDENSING PRESSURE

FIELD OF THE INVENTION

This invention relates to a refrigeration system with floating head pressure and with heat reclaim.

BACKGROUND OF THE INVENTION

An ordinary refrigeration system for supermarket application uses multiples evaporators to refrigerate or to maintain in frozen conditions different perishable food products. The refrigerant vapors from the evaporators are fed to the refrigeration compressors, several in number, where through a mechanical compression their pressure and temperature are increased. The high pressure hot refrigerant vapors are fed to an outdoor air cooled condenser, where the latent heat of the refrigerant vapors is absorbed by the outdoor air and as a result the refrigerant vapors are liquified. This liquid is fed through expansion valves, thus reducing its temperature and pressure, to the evaporators, where the liquified refrigerant evaporates absorbing heat from the surrounding food products.

The pressure and the temperature of the refrigerant vapors condensing in the air cooled condenser are subject of the outdoor air temperature. During the cold period of the year, even if there is a possibility to reduce the condensing pressure, a high condensing pressure is maintained artificially in order to provide a sufficient pressure differential for the proper operation of the expansion valves; another reason for maintaining a high condensing pressure during the cold periods of the year is the use of heat reclaim coils to recuperate the heat of condensation and use it for comfort heating of the building. In order to obtain an efficient heat transfer in the heat reclaim coil, a substantial difference between the indoor air temperature and the condensing temperature is required which can be provided only by increasing the condensing pressure.

It is well known that the refrigeration compressor energy consumption efficiency is function of the ratio between the condensing pressure and the evaporating pressure. By lowering the condensing pressure, the refrigerant capacity of the compressor is increased and its power consumption decreased.

A new technology exists today (liquid delivery system) allowing the refrigeration system to work with floating condensing pressure depending on the outdoor air temperature. This is achieved by installing a centrifugal pump on the line of liquid refrigerant after the condenser, thus providing the necessary pressure differential for the proper operation of the expansion valves using a very small amount of energy. The condensing temperature could be reduced to 60° F. depending on the outdoor air temperature.

The above mentioned technology produces energy savings up to 35% of the total energy cost but creates difficulties in the field of heat reclaim especially when a recuperation of the total condensing heat is required because the air to be heated is warmer then the refrigerant to be cooled. When a heat reclaim is required the condensing pressure has to be raised artificially in order to achieve proper heat transfer, thus losing the benefits of the liquid delivery system.

OBJECTS OF THE INVENTION

It is therefore the purpose of this invention to provide a method and a system facilitating the extraction of the total condensing heat of a refrigeration system having a floating condensing pressure without the necessity to increase the condensing pressure during the heat reclaim periods.

A feature of the invention is to provide a method and a system of heat reclaim adaptable to the existing refrigeration systems Another feature of the invention is the usage of the heat reclaim system for air conditioning and subcooling purposes.

SUMMARY OF THE INVENTION

The present invention is directed to a refrigeration system with heat reclaim and with floating condensing pressure, said system comprising at least one first compressor for compressing low pressure refrigerant gas from at least one first evaporator to elevate said gas pressure to an operating high pressure level, a first outdoor air cool condenser connected to said first compressor for cooling said high pressure refrigerant gas to produce a cooled operating liquid refrigerant for feeding said first evaporator through a first expansion valve, a first heat exchanger one side of which is series connected between said first compressor and said first condenser and the other side of which forms a second evaporator of a heat pump system which further includes at least one second compressor for compressing low pressure refrigerant gas from said second evaporator, at least one heat reclaim condenser connected to the high pressure side of said second compressor and to said second evaporator through a second expansion valve.

Preferably, the system further includes a valve for selectively cutting the connection between said first compressor and said first condenser and also a pressure regulating valve to maintain at a constant value the suction pressure of said second compressor.

Preferably, the system further includes a second outdoor air cooled condenser connected between said second compressor and a third expansion valve in a circuit bypassing said heat reclaim condenser, a receiver connected to the inlet of said second and third expansion valves and to the outlets of said heat reclaim condenser and of said second condenser, and remotely operated valves for selectively connecting said second condenser and said heat reclaim condenser to said receiver.

Preferably, there are several parallel circuits of first compressors, first evaporators and first expansion valves, series connected to a single first condenser and to said one side of a single first heat exchanger.

The invention is also directed to the combination of the above defined refrigeration system with a sub- cooling system which comprises a second heat exchanger one side of which is connected to the source of cooled liquid refrigerant of said refrigeration system and the other side of which forms a sub-cooling evaporator, a third compressor for compressing low pressure refrigerant gas from said sub-cooling evaporator to a high pressure level, a third outdoor air cooled condenser connected to said high pressure side of said third compressor and to said sub-cooling evaporator through a fourth expansion valve, and valve means to selectively connect said third compressor in the circuit of said heat pump system in parallel with said second compressor and disconnect said third compressor from said circuit.

The invention is also directed to the combination of the above defined refrigeration system with an air conditioning system which comprises an air conditioning evaporator connected to said receiver through a third expansion valve and through the suction side of said second compressor.

The invention is further directed to the combination of the above defined refrigeration, sub-cooling and air conditioning systems.

BRIEF DESCRIPTION OF THE DRAWINGS

In the annexed drawings, like reference characters indicate like elements throughout.

DETAILED DESCRIPTION OF PREFERRED EMBODIMENTS

Figure 1:
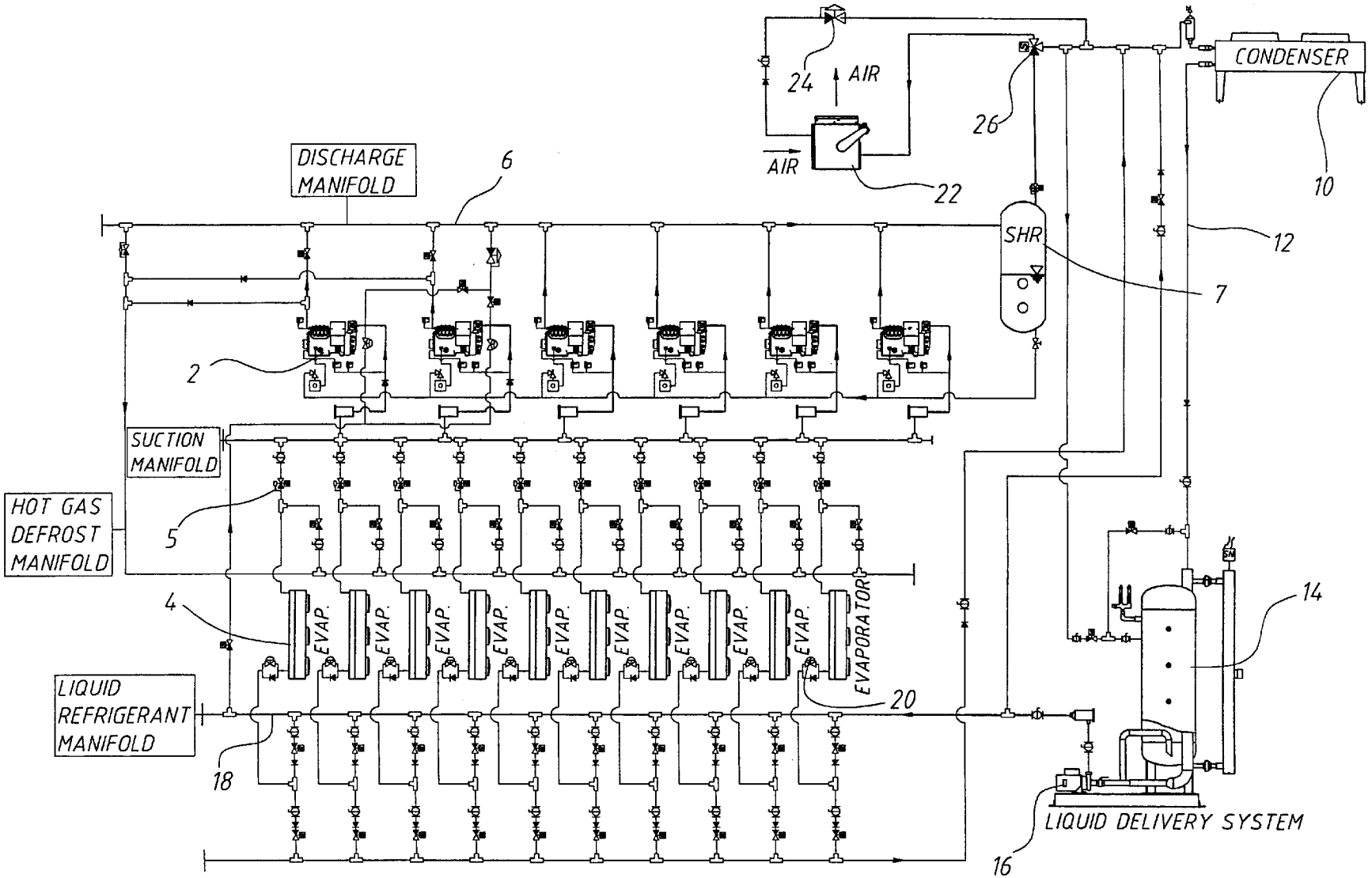
FIG. 1 (PRIOR ART)
FIG. 1 is a schematic of a refrigeration system with floating head pressure using a conventional heat reclaim system.

On FIG. 1 is shown a typical supermarket refrigeration system with conventional heat reclaim and liquid delivery system. The system utilizes several compressors 2 which compress the low pressure refrigerant vapors from the evaporators 4 which each has a conventional evaporator pressure regulating valve 5. The compressed refrigerant vapors from the compressors 2 are fed through the discharge manifold 6 and through the diverting valve 26 to the outdoor air cooled condenser 10 which is normally mounted on the build roof and where the vapors are condensed and fed from the outlet of the condenser 10 through the condensate return manifold 12 to the liquid delivery system 14. The pressure of the liquid refrigerant is increased by 25 to 35 PSIG by the liquid pump 16 and is fed through the liquid refrigerant manifold 18 and the expansion valves 20 to the evaporators 4. The system operates with floating condensing pressure and the low condensing pressure during the cold periods of the year is compensated by the pressure increase provided by the liquid pump 16 . The condensing pressure is solely dependent on the outdoor air temperature.

When a heat reclaim is required, the refrigerant compressed vapors are fed through the discharge manifold 6 and oil separator 7 to the diverting valve 26, which is switched to feed the heat reclaim coil 22. The pressure regulating valve 24, installed in the outlet of the heat reclaim coil 22, increases the discharge pressure during the heat reclaim cycle in order to provide the proper conditions for the heat transfer in the heat reclaim coil.

The increase of the discharge pressure during the heat reclaim cycle affects the energy consumption efficiency of the refrigeration compressors thus eliminating the benefits of the operation with low discharge pressure allowed by the usage of liquid delivery system.

Figure 2:
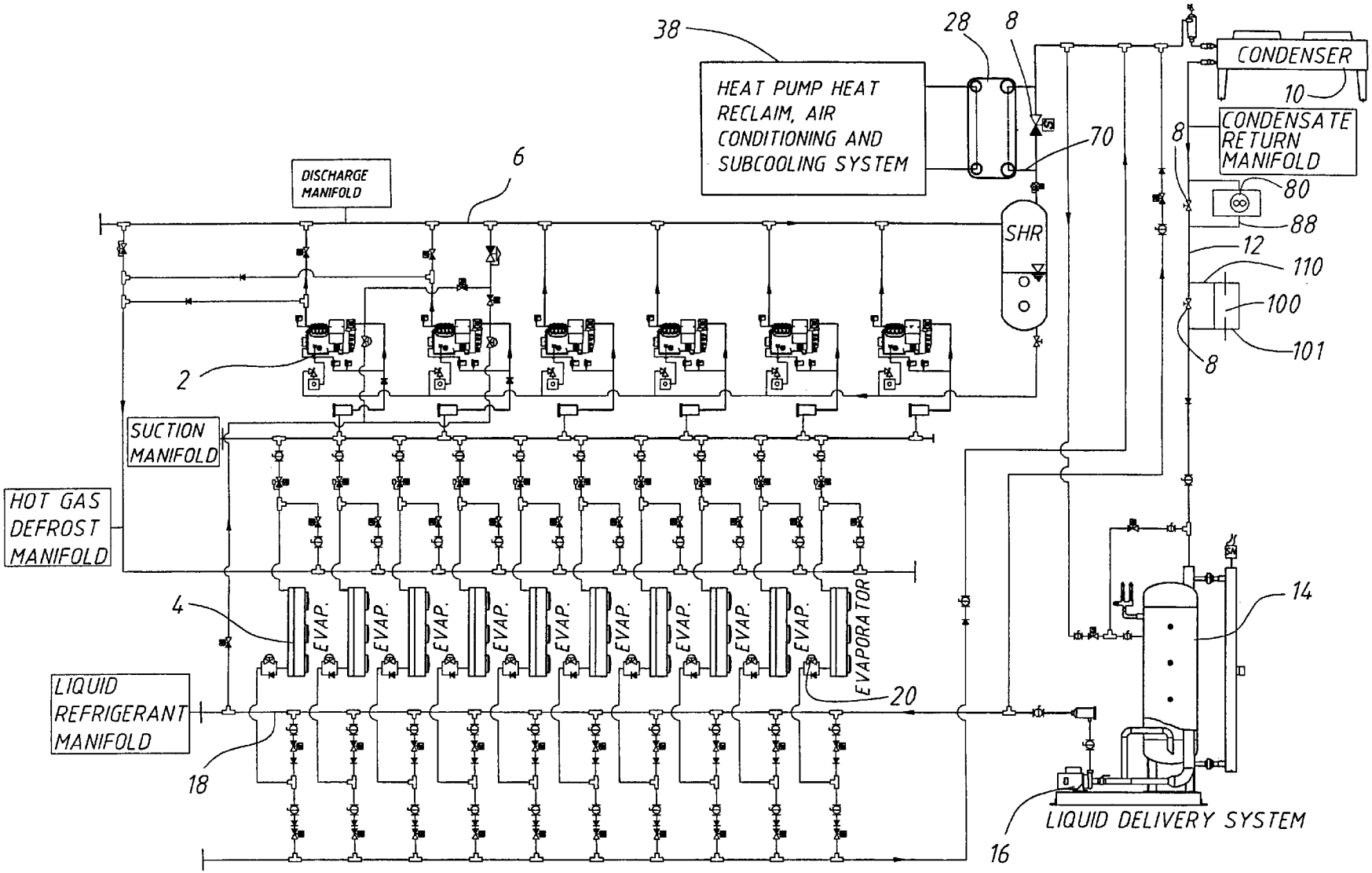
FIG. 2 is a schematic of a refrigeration system with floating condensing pressure using a heat pump heat reclaim system of an embodiment of the present invention.

On FIG. 2 is shown the same system as on FIG. 1 with modifications allowing the usage of the heat pump heat reclaim, air conditioning and subcooling system.

The system utilizes several compressors 2 which compress the low pressure refrigerant vapors from the evaporators 4. The compressed refrigerant vapors from the compressors 4 are fed through the discharge manifold 6 and through a solenoid valve 8 to the outdoor air cooled condenser 10 where they are condensed and fed from the outlet of the condenser 10 through the condensate return line 12 to the liquid delivery system 14. The pressure of the liquid refrigerant is increased by 25 to 35 PSIG by the liquid pump 16 and is fed through the liquid refrigerant manifold 18 and the expansion valves 20 to the evaporators 4. The system operates with floating condensing pressure and the low condensing pressure during the cold period of the year is compensated by the pressure increase provided by the liquid pump 16. The condensing pressure is solely dependent on the outdoor air temperature.

When a heat reclaim is required the solenoid valve 8 is closed and the refrigerant vapors compressed by the compressors 2 are fed to a heat exchanger 28 where the heat from the refrigerant vapors is removed by heat pump heat reclaim system generally shown at 30 and described in detail hereinafter.

The refrigerant is then fed to the outdoor air cooled condenser 10 and the liquid from the condenser outlet is fed through the condensate return manifold 12 to the liquid delivery system 14. The refrigerant pressure is increased by the liquid pump 16 and the refrigerant is fed through the expansion valves 18 to the evaporators 4.

Figure 3:
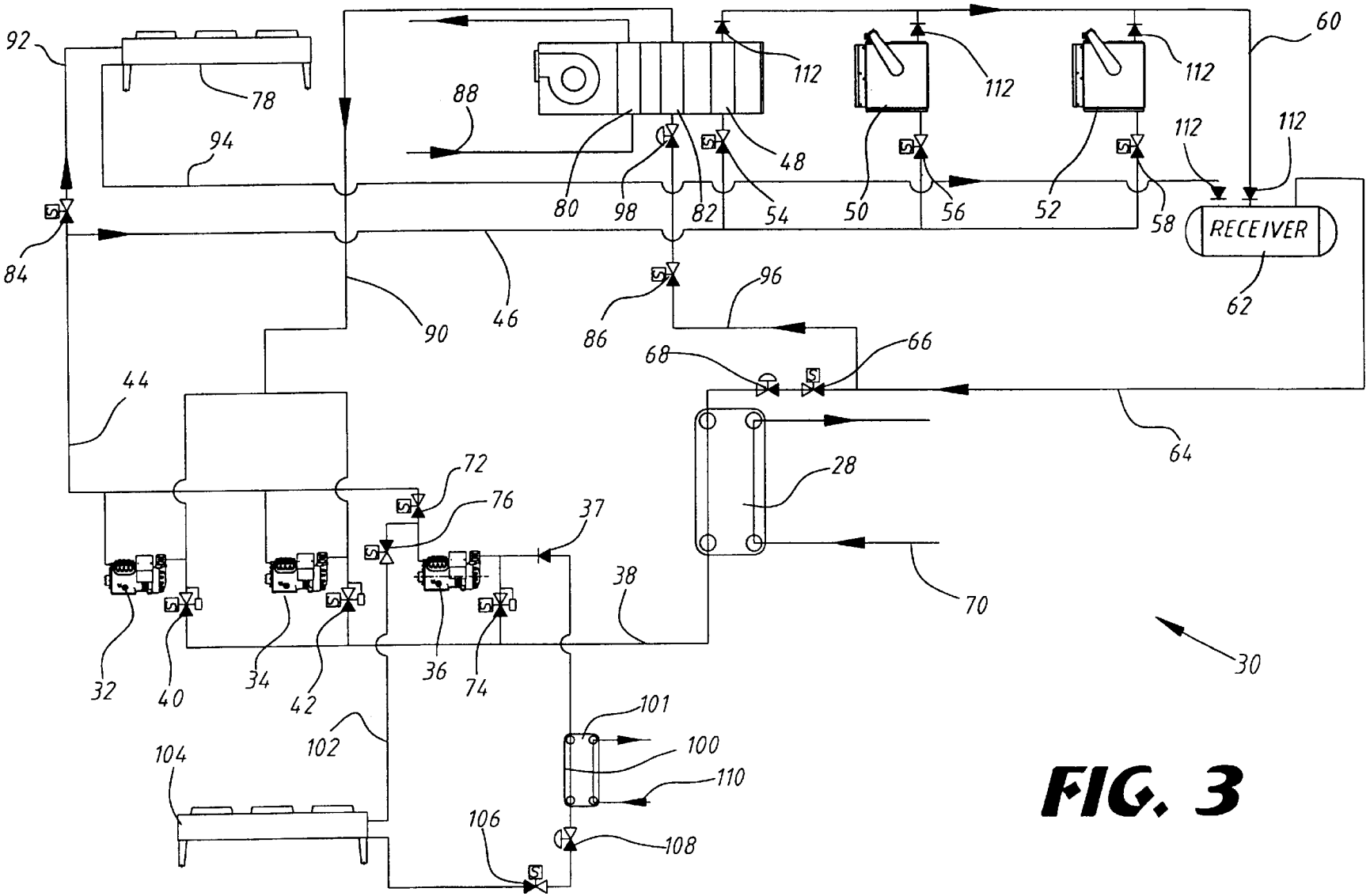
FIG. 3 is a schematic of a heat pump heat reclaim system combined with air conditioning and subcooling circuits.

The extraction of the heat from the compressed refrigeration vapors is done without increasing the discharge pressure of the refrigeration system thus allowing the compressors to work with very high energy consumption efficiency. The operation of the refrigeration system is completely independent from the requirements for heat reclaim as the control of the heat reclaim is provided solely by the heat pump heat reclaim system 30. It is possible to extract the total condensing heat from the refrigeration system without affecting the operation conditions of the said system. All benefits of the usage of the liquid delivery system are present during the heat reclaim cycle. The heat pump heat reclaim system 30 is easily adaptable to any existing refrigeration unit using a liquid delivery system. On FIG. 3 is shown the schematic of the heat pump heat reclaim, air conditioning and subcooling system 30.

The compressors 32 and 34 are used for heat reclaim and air conditioning. The compressor 36 is used for heat reclaim and subcooling.

When the system is in heat reclaim mode the refrigerant vapors from heat exchanger 28 (see also FIG. 2) are fed through conduit 38 and pressure regulating valves 40 and 42 to compressors 32 and 34. The pressure regulating valves 40 and 42 will maintain the suction pressure of the compressors 32 and 34 at constant value corresponding to an evaporating temperature of 50° F. The compressed refrigerant vapors then are fed through conduits 44 and 46 to the heat reclaim condensers 48, 50 and 52 through the solenoid valves 54, 56 and 58. The totally condensed refrigerant is then fed through the conduit 60 to the receiver 62. From the receiver 62 the refrigerant is fed through conduit 64 solenoid valve 66 and expansion valve 68 to the heat exchanger 28, where the refrigerant evaporates absorbing the heat from the compressed vapors of the refrigeration system brought to the exchanger 28 by conduit 70. The evaporated refrigerant is fed again through conduit 38 to compressors 32 and 34. By opening the solenoid valve 72, opening the pressure regulating valve 74 and closing the solenoid valve 76, the compressor 36 can be also incorporated into the heat reclaim circuit if there is a requirement for more heat.

In heat reclaim mode the condenser 78, dehumidifying coil 80 and air conditioning coil 82 of the air handling unit 83 are not operational and are separated from the heat reclaim circuit by closing the solenoid valves 84, 86 and the diverting valve 8 on line 12 connected across the refrigerant system liquid lines 88 as shown in FIG. 2.

In air conditioning and subcooling mode the low pressure refrigerant vapors from air conditioning evaporator 82 are fed through conduit 90 to the suction of compressors 32 and 34. The compressed refrigerant vapors are then fed through conduit 44, solenoid valve 84, now open and conduit 92 to the outdoor air cooled condenser 78 where the refrigerant vapors condense and the refrigerant liquid is fed through conduit 94 to the receiver 62. From receiver 62 the refrigerant is fed through the conduit 64, conduit 96 , solenoid valve 86 and expansion valve 98 to the air conditioning evaporator 82. The liquid refrigerant from the refrigeration system is fed (also see FIG. 2) through conduit 88 to the dehumidifying coil 80 where the cold air obtained from the air conditioning evaporator 82 is reheated in order to reduce its relative humidity.

The suction of compressor 36 is connected to the outlet of subcooling evaporator 100 which forms one side of a heat exchanger 101, the other side of which is connected through conduit 110 to conduit 12 which has a solenoid valve 8. The refrigerant vapors compressed by compressor 36 are then fed through solenoid valve 76 and conduit 102 to the outdoor air cooled condenser 104 (can be joined to condenser 78) where the refrigerant vapors condense and are fed through solenoid valve 106 and expansion valve 108 to the subcooling evaporator 100 where the evaporating refrigerant removes heat from the liquid refrigerant in conduit 12 (FIG. 2) of the refrigeration system liquid refrigerant fed to the subcooling evaporator 100 from the outlet of dehumidifying coil 80 through conduit 110.

In air conditioning and subcooling mode, the heat reclaim condensers 48,50 and 52 are not operational and are separated from the air conditioning circuit by closing the solenoid valves 54,56 and 58. The heat exchanger 28 is not operational and solenoid valve 66 is closed. Pressure regulating valves 40 and 42 are closed.

Check valves 112 are provided at the outlets of heat reclaim condensers 48, 50 and 52 and on conduits 60 and 92 at the inlets of receiver 62.

It should be noted that the heat pump system of the invention utilizes, during the cold period of the year, the main components of the air conditioning and subcooling system normally installed in a supermarket and not then in use.

I claim:

1. A refrigeration system with heat reclaim and with floating condensing pressure, said system comprising at least one first compressor for compressing low pressure refrigerant gas from at least one first evaporator to elevate said gas pressure to an operating high pressure level, a first outdoor air cool condenser connected to said first compressor for cooling said high pressure refrigerant gas to produce a cooled operating liquid refrigerant for feeding said first evaporator through a first expansion valve, a first heat exchanger one side of which is series connected between said first compressor and said first condenser and the other side of which forms a second evaporator of a heat pump system which further includes at least one second compressor for compressing low pressure refrigerant gas from said second evaporator, at least one heat reclaim condenser connected to the high pressure side of said second compressor and to said second evaporator through a second expansion valve.

2. A refrigeration system as defined in claim 1, further including a valve for selectively cutting the connection between said first compressor and said first condenser.

3. A refrigeration system as defined in claim 2, further including a pressure regulating valve to maintain at a constant value the suction pressure of said second compressor.

4. A refrigeration system as defined in claim 3, further including a second outdoor air cooled condenser connected between said second compressor and a third expansion valve in a circuit bypassing said heat reclaim condenser, a receiver connected to the inlet of said second and third expansion valves and to the outlets of said heat reclaim condenser and of said second condenser and remotely operated valves for selectively connecting said second condenser and said heat reclaim condenser to said receiver.

5. A refrigeration system as defined in claim 4, in combination with a sub-cooling system which comprises a second heat exchanger one side of which is connected to the source of cooled liquid refrigerant of said refrigeration system and the other side of which forms a sub-cooling evaporator, a third compressor for compressing low pressure refrigerant gas from said sub-cooling evaporator to a high pressure level, a third outdoor air cooled condenser connected to said high pressure side of said third compressor and to said sub-cooling evaporator through a fourth expansion valve, and valve means to selectively connect said third compressor in the circuit of said heat pump system in parallel with said second compressor and disconnect said third compressor from said circuit.

6. A refrigeration system as defined in claim 4, in combination with an air conditioning system which comprises an air conditioning evaporator connected to said receiver through a third expansion valve and through the suction side of said second compressor.

7. A refrigeration system as defined in claim 5, in combination with an air conditioning system which comprises an air conditioning evaporator connected to said receiver through a third expansion valve and through the suction side of said second compressor.

8. A refrigeration system as defined in claim 1, wherein there are several parallel circuits of first compressors, first evaporators and first expansion valves, series connected to a single first condenser and to said one side of a single first heat exchanger.

9. A refrigeration system as defined in claim 8, further including a valve for selectively cutting the connection between said first compressors and said single first condenser.

10. A refrigeration system as defined in claim 9, further including a pressure regulating valve to maintain at a constant value the suction pressure of said second compressor.

11. A refrigeration system as defined in claim 10, further including a second outdoor air cooled condensor connected between said second compressor and a third expansion valve in a circuit by passing said heat reclaim condenser, a receiver connected to the inlet of said third expansion valve and to the outlets of said heat reclaim condenser and of said second condenser and remotely operated valves for selectively connecting said second condenser and said heat reclaim condenser to said receiver.

12. A refrigeration system as defined in claim 11, further including a sub-cooling system which comprises a second heat exchanger one side of which is connected to the source of cooled liquid refrigerant of said refrigeration system and the other side of which forms a sub-cooling evaporator, a third compressor for compressing low pressure refrigerant gas from said sub-cooling evaporator to a high pressure level, a third outdoor air cooled condenser connected to said high pressure side of said third compressor and to said sub-cooling evaporator through a fourth expansion valve, and valve means to selectively connect said third compressor in the circuit of said heat pump system in parallel with said second compressor and disconnect said third compressor from said circuit.

13. A refrigeration system as defined in claim 12, in combination with a heat pump system which comprises said second evaporator connected to said receiver through said second expansion valve and through the suction side of said third compressor.

* * * * *